US005124104A

United States Patent [19]

Holley

[11] Patent Number: 5,124,104

[45] Date of Patent: Jun. 23, 1992

[54] COAL POND FINES AGGLOMERATION

[76] Inventor: Carl A. Holley, 14315 Tall Oaks, Riverview, Mich. 48192

[21] Appl. No.: 700,438

[22] Filed: May 15, 1991

[51] Int. Cl.[5] ..... B29B 9/08

[52] U.S. Cl. ..... 264/113; 23/313 P; 44/593; 264/117; 425/222; 427/180; 427/212

[58] Field of Search ..... 264/112, 113, 117; 425/222; 427/180, 212; 23/313 P; 44/550, 551, 559, 580, 592, 593

[56] References Cited

U.S. PATENT DOCUMENTS

| | | | |
|---|---|---|---|
| 2,665,977 | 1/1954 | Engelhart | 44/559 |
| 3,030,657 | 4/1962 | Van Reppert | 23/313 P |
| 3,408,169 | 10/1968 | Thompson et al. | 23/314 |
| 3,536,475 | 10/1970 | Trub | 23/313 P |
| 3,665,066 | 5/1972 | Capes et al. | 23/314 |
| 4,064,212 | 12/1977 | Kleeberg et al. | 264/117 |
| 4,219,519 | 8/1980 | Goksel | 264/82 |
| 4,259,085 | 3/1981 | Ban et al. | 44/550 |
| 4,504,306 | 3/1985 | Miyashita et al. | 23/313 P |
| 4,857,359 | 8/1989 | Groher et al. | 427/6 |
| 4,973,237 | 11/1990 | Hajou et al. | 425/222 |

*Primary Examiner*—Mary Lynn Theisen
*Attorney, Agent, or Firm*—William J. Ruano

[57] ABSTRACT

A process for producing spherical pellets from wet coal silt or also known as filter cake. The process involves mixing dry ash with the filter cake in a mixer. The blend thereof is discharged into a shallow pan disc pelletizer to produce pellets which are then coated in a reroll ring surrounding the disc pelletizer with more fly ash.

7 Claims, 2 Drawing Sheets

COAL POND FINES AGGLOMERATION

BACKGROUND OF THE INVENTION

The very fine coal silt that has been stored in ponds is a very serious problem of containment and land use. This coal often has "high" sulfur which can leach into the ground water. With the new advent of circulating fluidized bed combustors, this low energy coal can be safely combusted without the danger of sulfur emission into the atmosphere. The major problem is that this material is too wet and too fine to be handled and fed into the combustor.

SUMMARY OF THE INVENTION

An object of the invention is to overcome the abovementioned problems by providing a method of producing low cost pellets which can be handled and fed into the furnace without removing the moisture. This process flow diagram is shown in FIG. 1 of the drawings.

DETAILED DESCRIPTION OF THE PREFERRED EMBODIMENT

Figure 1:
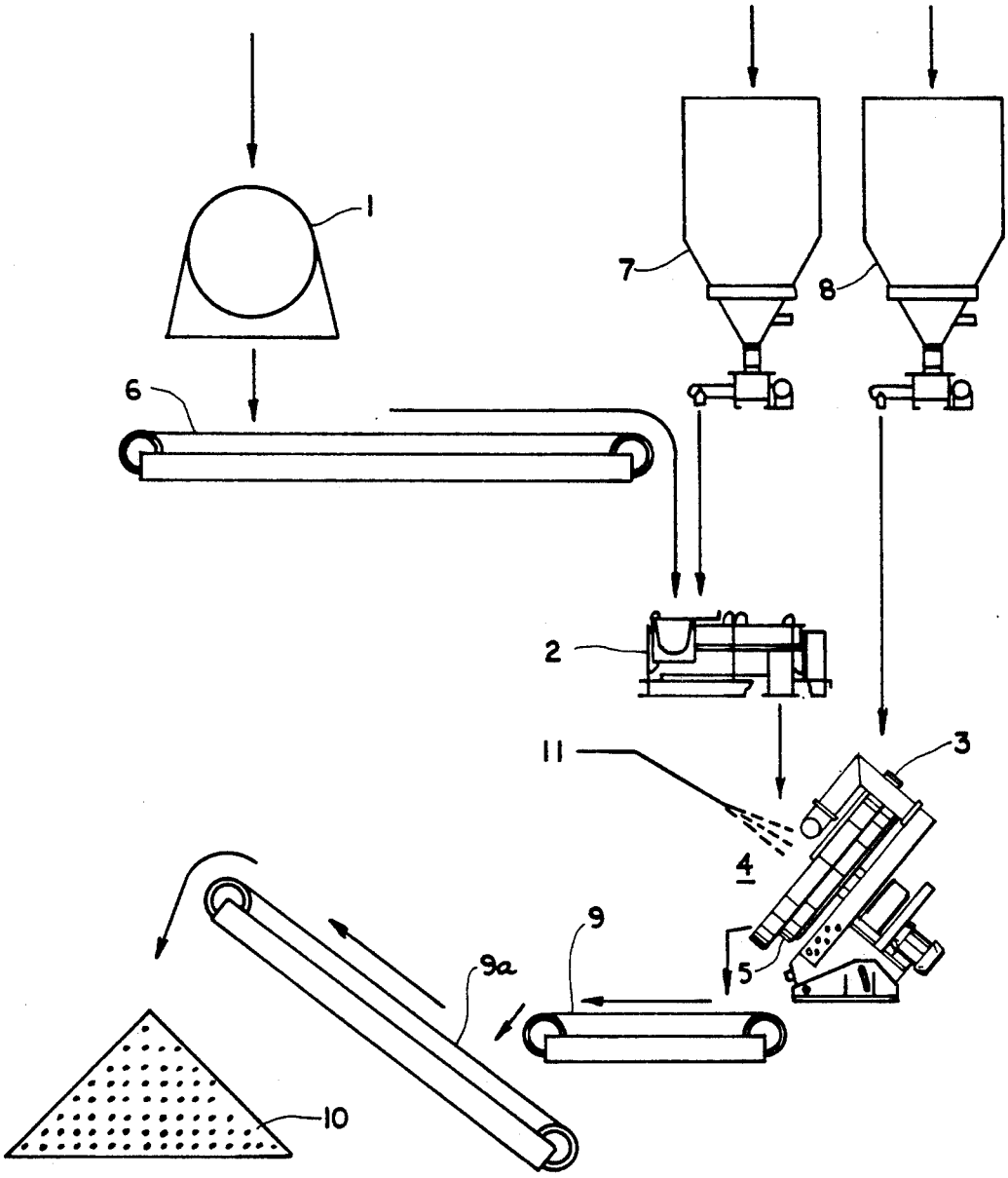
FIG. 1 is a process flow diagram of the various steps of the invention.

Referring more particularly to FIG. 1,

The coal slurry from the pond can be processed through a vacuum or belt filter 1 or it can be piled on the side of the pond and permitted to drain. The wet coal silt or also known as cake, having from 15 to 40% moisture, is fed by belt 6 into a high intensity mixer 2 together with fly ash or bed drain ash in surge bin 7 which has been collected in the dust collection system of the fluidized bed combuster. The fly ash addition in the mixer is between 1 and 50% of the dry weight of the coal silt. The correct proportions of the two materials are added so that the discharge from the mixer 2 is at "pelletizing moisture". The most effective mixer to utilize is the agglomeration device described in my U.S. Pat. No. 4,881,887 issued on Nov. 21, 1989, together with the reroll ring of the present application, but almost any mixer can be utilized with substantially the same success. The cake and ash must be thoroughly blended to produce a homogeneous mixture which is discharged directly into a shallow pan disc pelletizer 5'.

The shallow pan disc pelletizer described in my U.S. Pat. No. 4,726,755 issued on Feb. 23, 1988 is most effective for this application, but almost any commercially available disc pelletizer can be made to function in this process. The disc pelletizer 5 should be equipped with a spray system so that water from source 11 can be added to the rolling material to control the size of the pellets.

Figure 2:
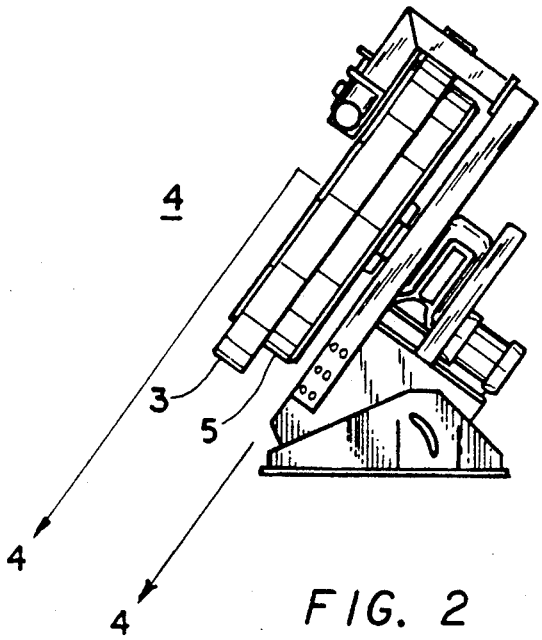
FIG. 2 is an enlarged side view of the disc pelletizer.
Figure 3:
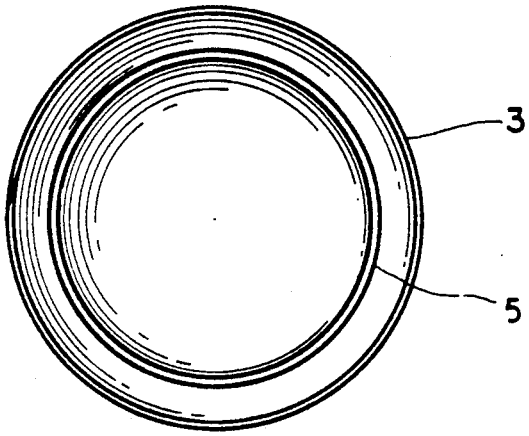
FIG. 3 is a top view of the shallow pan disc pelletizer and reroll ring.
Figure 4:
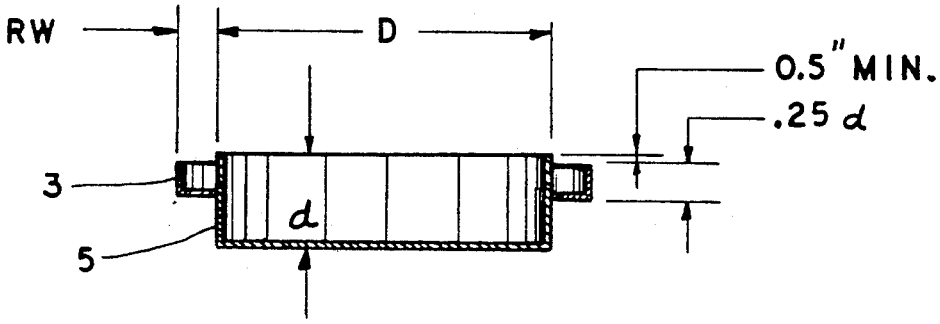
FIG. 4 is a cross sectional view taken along line 4—4 of FIG. 2.

After pellets are formed in the shallow pan 5, they are discharged over the edge into a reroll ring 3 as shown in FIGS. 1, 2 and 3. To have the most satisfactory operation of the disc pelletizer, it has been found that the shallow pan 5 depth should have an exponential relation to the pan diameter and the reroll ring width should also have an exponential relation to the pan diameter.

These relationships are:

$d = D^{0.58}$ $RW = D^{0.65}$ d = pan depth in inches

D = pan diameter in inches

RW = width of the reroll ring

The depth of the reroll ring 3 is best established at $\frac{1}{4}$ of the depth of the pan.

Additional fly ash or bed drain ash from surge bin 8 is added to the pellets in the reroll ring 3. Normally from 1 to 5% of the dry weight of the pellets is added in the form of dry fly ash. The aluminates and silicates in the fly ash coating react with the unreacted lime CaO, also in fly ash to form a pozzuolanic cement which effectively seals the surface of the pellets. The coated pellets exiting the reroll ring **3*a* can be placed in a weather protected stockpile 10 by conveyers 9 and 9*a*** or can be fed directly into the combustor.

In the stockpile 10, the fly ash or bed drain ash hydrates so that all of the free moisture is utilized and the pellets become dry and durable enough to be fed through a normal material handling system into the fluid bed combustor. A secondary advantage to this system is the fact that the lime (CaO) in the ash which was not reacted on the initial combustion stage will now be reacted.

While I have illustrated and described a single specific embodiment of my invention, it will be understood that this is by way of illustration only and that various changes and modifications may be contemplated in my invention within the scope of the following claims.

I claim:

1. A process for producing spherical pellets from wet coal silt, comprising mixing dry fly ash with the coal silt in a mixer and discharging the blend onto a shallow pan disc pelletizer where pellets are produced and then coating the pellets in a reroll ring surrounding said disc pelletizer with more fly ash.

2. A process as recited in claim 1 in which the mixer is a high intensity mixer.

3. A process as recited in claim 1 in which said coal silt contains between 15 and 40% water.

4. A process as recited in claim 1 in which said coal silt contains between 20 and 30% water by weight.

5. A process as recited in claim 1 in which said fly ash addition in the mixer is between 1 and 50% of the dry weight of the coal silt.

6. A process as recited in claim 1 in which the fly ash addition at the reroll ring is 1 to 5% of the dry weight of the pellets.

7. A process as recited in claim 1 in which the proportions of the shallow pan disc pelletizer are $$d = D^{0.58}$$

Where:

d = pan depth in inches

D = pan diameter in inches.

* * * * *